US006293874B1

(12) United States Patent
Armstrong

(10) Patent No.: US 6,293,874 B1
(45) Date of Patent: Sep. 25, 2001

(54) USER-OPERATED AMUSEMENT APPARATUS FOR KICKING THE USER'S BUTTOCKS

(76) Inventor: Joe W. Armstrong, 306 Kingston St., Lenoir, TN (US) 37771-2408

( * ) Notice: Subject to any disclaimer, the term of this patent is extended or adjusted under 35 U.S.C. 154(b) by 0 days.

(21) Appl. No.: 09/477,175

(22) Filed: Jan. 4, 2000

(51) Int. Cl.[7] ..... A63H 37/00
(52) U.S. Cl. ..... 472/51; 472/55
(58) Field of Search ..... 472/51, 55, 137; 482/51, 72, 148

(56) References Cited

U.S. PATENT DOCUMENTS

| | | | | |
|---|---|---|---|---|
| 654,611 | | 7/1900 | De Moulin . | |
| 920,837 | | 5/1909 | De Moulin . | |
| 953,411 | | 3/1910 | De Moulin . | |
| 966,935 | | 8/1910 | Mamaux . | |
| 976,851 | | 11/1910 | De Moulin . | |
| 1,175,372 | | 3/1916 | Newcomb . | |
| 4,457,100 | * | 7/1984 | Nightingale | 446/333 |
| 5,785,601 | * | 7/1998 | Kubesheski et al. | 472/135 |

* cited by examiner

*Primary Examiner*—Joe H. Cheng
*Assistant Examiner*—Kim T. Nguyen
(74) *Attorney, Agent, or Firm*—Pitts & Brittian, P.C.

(57) ABSTRACT

An amusement apparatus including a user-operated and controlled apparatus for self-infliction of repetitive blows to the user's buttocks by a plurality of elongated arms bearing flexible extensions that rotate under the user's control. The apparatus includes a platform foldable at a mid-section, having first post and second upstanding posts detachably mounted thereon. The first post is provided with a crank positioned at a height thereon which requires the user to bend forward toward the first post while grasping the crank with both hands, to prominently present his buttocks toward the second post. The second post is provided with a plurality of rotating arms detachably mounted thereon, with a central axis of the rotating arms positioned at a height generally level with the user's buttocks. The elongated arms are propelled by the user's movement of the crank, which is operatively connected by a drive train to the central axis of the rotating arms. As the user rotates the crank, the user's buttocks are paddled by flexible shoes located on each outboard end of the elongated arms to provide amusement to the user and viewers of the paddling. The amusement apparatus is foldable into a self-contained package for storage or shipping.

14 Claims, 7 Drawing Sheets

USER-OPERATED AMUSEMENT APPARATUS FOR KICKING THE USER'S BUTTOCKS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

The invention relates to a user-operated amusement apparatus. More specifically, the invention relates to an amusement apparatus including a user-operated and controlled plurality of rotating members for self-kicking the user's buttocks.

2. Description of the Related Art

Prior art devices include individual spanking devices that must be reloaded or reset after each individual spanking action. Typical prior art devices provide a paddle that can pivot once, upon being triggered, to spank a hand or buttocks of the user. In U.S. Pat. No. 920,837, issued to De Moulin, a device is disclosed for lifting and spanking of the user for secret society initiation ceremonies. The device includes a trick lifting machine having a spring member, lever, and manual actuation for triggering the paddle release. The actuation by a user releases the spring member, pivoting the paddle, and striking a user straddled over the device. The spring and paddle are reset after each actuation.

This and other known devices of the type, disclose spring activated, individual paddle actions that must be reset alter each contact with the user, with associated repositioning of the user in a posture to accept the next individual paddle action.

Therefore, it is an object of the present invention to provide an amusement apparatus which is user-operated and controlled, and is designed to inflict repetitive blows on the user without resetting of the apparatus and/or repositioning of the user between blows.

It is another object of the present invention to provide an amusement apparatus having a user controlled crank regulating the frequency and force of the blows inflicted upon the user's buttocks.

It is another object of the present invention to provide an amusement apparatus for self-inflicting repetitive blows to a user and which is foldable into a self-containing package for storage or shipping.

BRIEF SUMMARY OF INVENTION

An amusement apparatus that includes a user-operated and controlled device for self-infliction of repetitive blows to the user's buttocks including a plurality of rotating arms bearing flexible extensions for self-paddling the user's buttocks. The amusement apparatus includes a platform having a first upstanding post detachably positioned near a first end of the platform, and having a second upstanding post detachably positioned near a second end of the platform. The first post is provided with a crank suitable to be grasped by the user's hands for rotation of the crank at a speed and with a force determined by the user. The second post includes a top end onto which there is mounted a plurality of elongated arms, each of which includes an outboard end having a pliable paddle, a flexible shoe, or the like mounted thereon. The plurality of arms are rotatably disposed within a vertical plane which is substantially parallel with the vertical plane occupied by the first post.

The second upstanding post is positioned a sufficient distance away from the first post to permit a user to locate his or her body between the posts, and at a height so that the user grasps and operates the hand crank mounted on the first post, while stooping, thereby positioning predominantly the user's backside toward the second post. The hand crank is operatively connected to the plurality of rotating arms such that the user controls the speed of rotation and the force transferred by the rotating arms. As the user operates the hand crank, the paddles, shoes, or the like mounted on the outboard ends of the rotating arms inflict repetitive blows to the user's buttocks. The amusement apparatus is foldable into a self-containing package for storage or shipping.

BRIEF DESCRIPTION OF SEVERAL VIEWS OF DRAWINGS

Other objects and advantages of the present invention will be recognized from the description of the invention contained herein, including reference to the claims and the drawings in which:

DETAILED DESCRIPTION OF THE INVENTION

Figure 1:
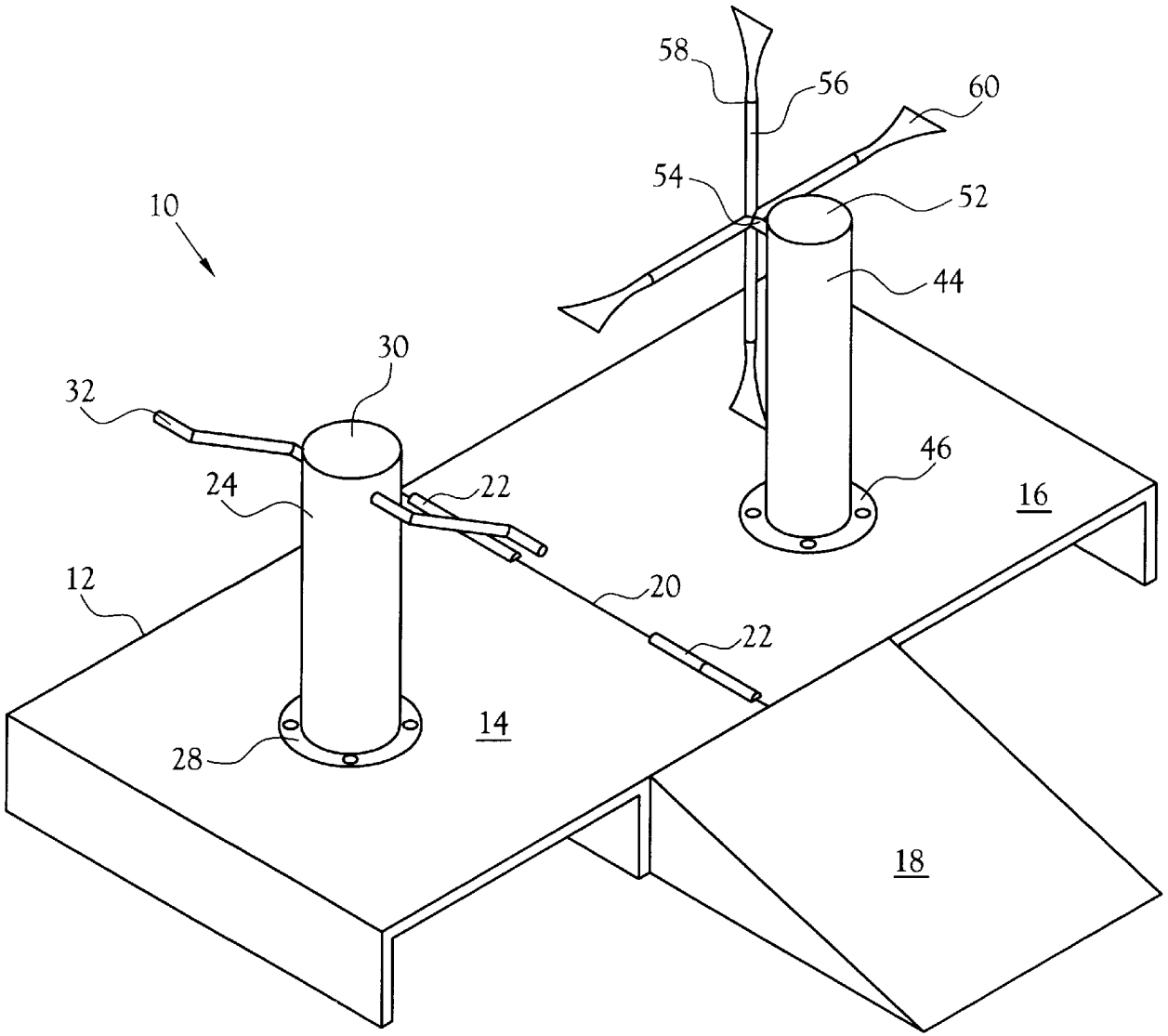
FIG. 1 is a perspective view of one embodiment of an amusement apparatus embodying various features of the present invention.
Figure 2:
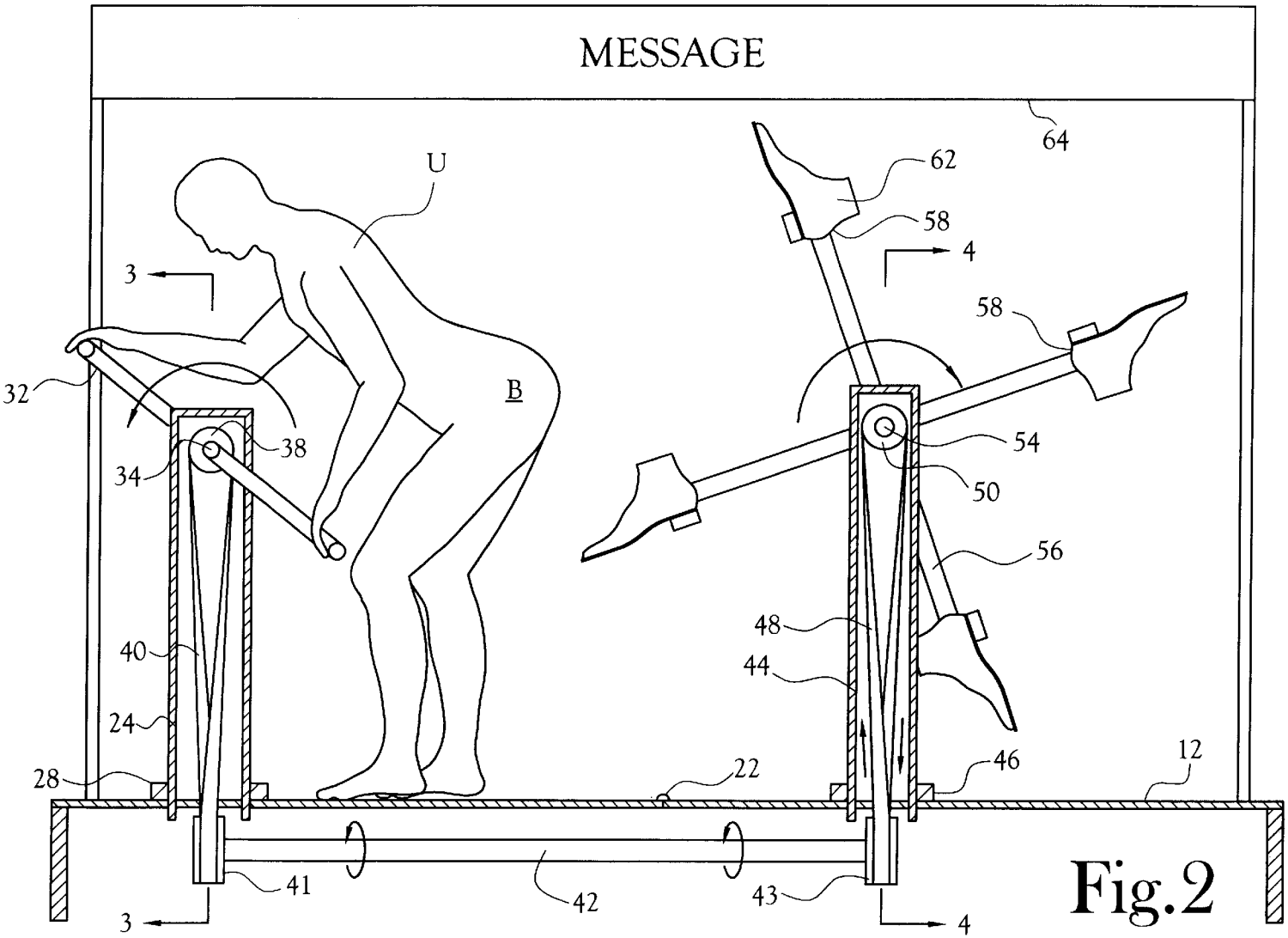
FIG. 2 is a side view, partial cutaway of the apparatus depicted in FIG. 1 and illustrating a user positioned to operate the apparatus of FIG. 1.

In accordance with the present invention, an amusement apparatus is provided that includes a user-operated and controlled apparatus for self-infliction of repetitive blows to the user's buttocks including a plurality of rotating arms bearing flexible extensions for self-paddling the user's buttocks B. FIGS. 1–8, illustrate the amusement apparatus 10 for self-paddling a user U. As illustrated in FIG. 1 and 2, the self-paddling apparatus 10 includes a display platform 12 having a hollow interior and having a first end 14 portion and a second end 16 portion. The platform 12 is constructed of materials adequate to support the weight of at least a few people standing on the platform, such as a user and an observer. In one embodiment, the platform 12 includes at least two generally equally sized subunits that are connectable at the mid-section 20 for folding together after any upstanding posts mounted thereon are detached. The first end 14 portion and the second end 16 portion includes storage compartments within the hollow platform 12 for storage of disassembled components connectable to the platform 12. The first end 14 is connected at the mid-section hinges 20 to the second end 16 by a plurality of hinges 22. Once the upstanding posts and accessories are detached, disassembled and stored, the platform 12 is foldable and securable for storage or moving to the next location for reassembly, display, and use for self-paddling.

An alternate embodiment of the platform 12 includes additional subunits coupled to the first end 14 portion and second end 16 portion, the subunits providing outer asubunits (not shown) that provide additional surface width for positioning of a second user of the amusement apparatus 10, for positioning of one or more observers, and/or for connecting of support structures for signs. A ramp 18 is detachably positioned to abut against the front portion of the platform 12 (see FIG. 1). The multiple subunits are of different sizes and are of generally square or rectangular shapes to allow disassembly and partial reassembly of the subunits in differently sized spaces as found at craft fairs, county fairs, exhibition halls, and circuses.

On the first end 14 portion, a first upstanding post 24 is positioned, with the base 26 of the first post detachably connected to the platform 12 surface by connector bolts (see FIG. 2). The first post 24 is hollow and is cylindrical, or a similar multi-sided elongated shape, to allow an internal placement of belts of a drive train (discussed below). The base 26 of the first post 24 includes a detachable collar 28 for connection to the surface of the platform 12. The first post 24 includes a top end 30 having a hand crank 32 with a crank axis 34 connectable toward the top end 30 (see FIG. 2 and 3). The crank 32 is positioned at a height on the post 24 which requires the user to bend forward toward the first post while grasping the crank with both hands (see FIG. 2). The hand crank 32 includes hand grips 36 to allow a user to grip the crank 32, to rotate the crank at variable speeds, and with variable force. The crank 32 is operatively interconnected to a plurality of rotating arms 56 having a rotational axis member 54 coupled to a second upstanding post 44 by a drive train consisting of a series of pulleys, belts, and at least one central shall 42 (see FIG. 2).

The central shaft 42 transfers rotational energy provided by the user at the crank 32, to the plurality of rotating arms 56 rotatable around the rotational axis member 54 coupled to the second post 44. Within the hollow first post 24 there is positioned a first pulley means such as a crank pulley 38, that is connected to the crank 32. A first flexible continuous loop means, such as a crank belt 40, is entrained about the crank pulley 38 and connects with a first end of the shaft 42 having a third pulley 41 secured thereon, with the crank belt 40 entrained around the third pulley 41 (see FIG. 2 and 2). When the crank 32 is rotated, the crank belt 40 moves accordingly, rotating the third pulley 41 and shaft 42.

Figure 4:
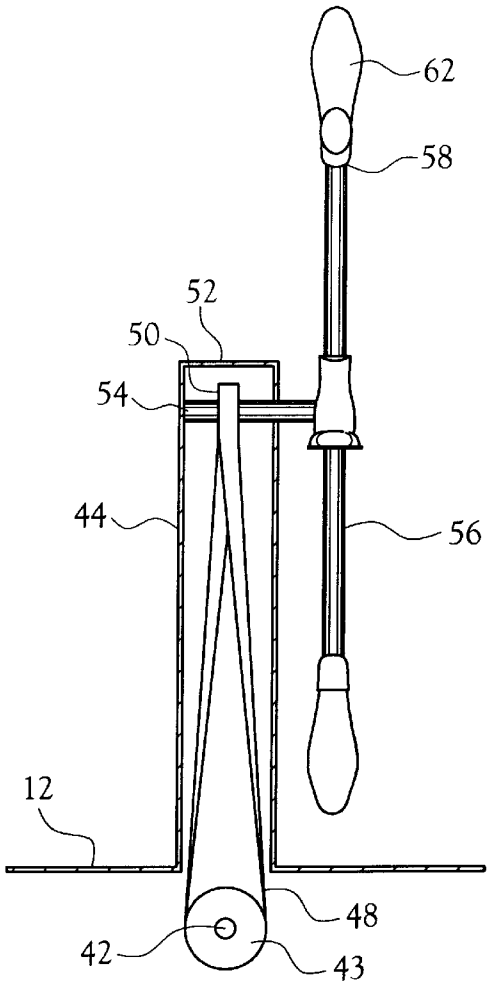
FIG. 4 is a sectional view taken generally along line 4—4 of FIG. 2, illustrating the drive means connecting the rotating arms and drive shaft of the present invention.
Figure 3:
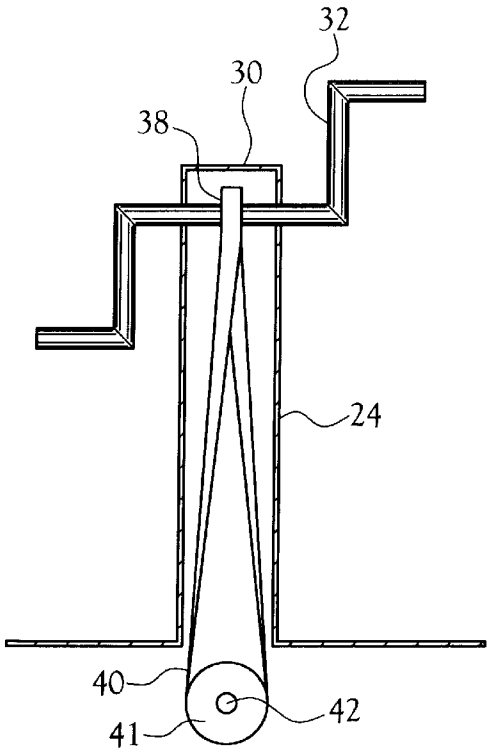
FIG. 3 is a sectional view taken generally along line 3—3 of FIG. 2, illustrating the drive means connecting the crank and drive shaft of the present invention.
Figure 5:
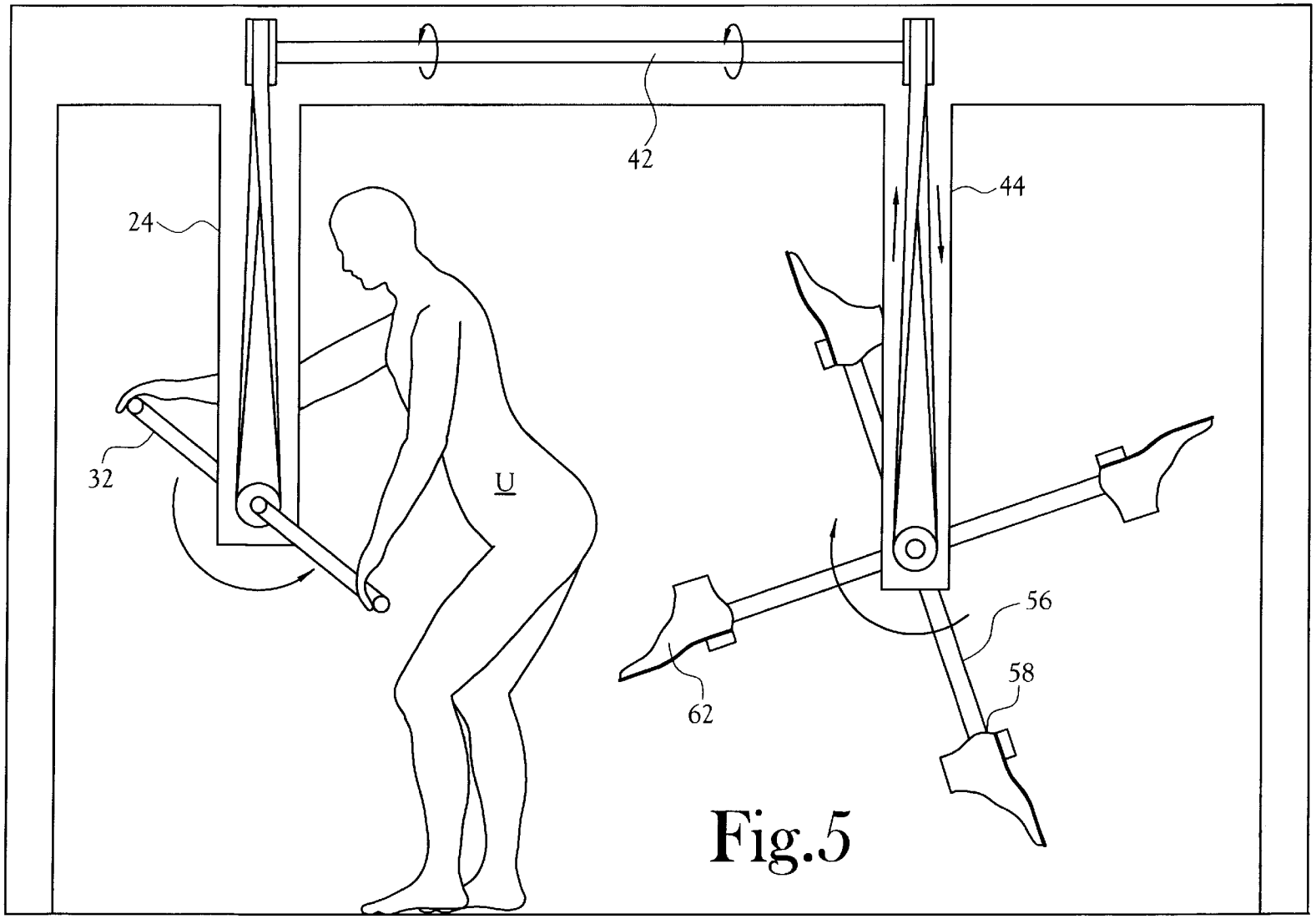
FIG. 5 is an side view representation of an alternative embodiment of the drive means for connecting the crank and the rotating arms of the present invention.

A fourth pulley 43 in secured to the second end of the shaft 42, with the fourth pulley 43 having a second flexible continuous loop means such as a second belt 48 entrained about the fourth pulley 43 (see FIG. 2 and 4). The second belt 48 extends into the second post 44, and is entrained about a second pulley means such as a second pulley 50 that is secured to the central axis member 54 of the plurality of rotating arms 56. When the shaft 42 is rotated, the second belt 48 moves the second pulley 50 and rotating arms 56 accordingly (see FIG. 2 and 4). The rate of rotation of the rotating arms 56 is a function of the user's rate of rotation of the crank 32, with the user controlling the frequency of rotation and the degree of force transmitted from the crank 32, through shaft 42, to the plurality of rotating arms 56 contacting the user's buttocks.

In one embodiment, the central shaft 42 is positioned underneath the platform 12, in alignment between the first post 24 and the second post 44 (see FIG. 2). In an alternate embodiment, the central shaft 42, along with associated pulleys and belts, is positioned above the platform 12, extending above and between the first post 24 and the second post 44 (see FIG. 5). In another alternate embodiment, the central shaft 42, along with associated pulleys and belts, is positioned toward the front or the back side of the platform 12, either above the platform (not shown), or below the platform (see FIG. 6).

The second post 44 is positioned a sufficient distance from the first post 24 to permit the user to require the user to bend forward at the waist in a stooped position between the posts 24, 44. The user is thus positioned to predominantly present his or her buttocks B toward the plurality of rotating arms 56 that are detachably mounted on the second post 44 at a height generally level with the user's buttocks. The second post 44 is mountable on the surface of the platform 12 by a detachable collar 46 and connector bolts or screws.

The second post 44 includes a top end 52, through which a rotational axis member 54 is inserted to allow rotation of the plurality of rotating arms 56 around the axis 54 (see FIG. 4). The rotating arms 56 are disposed within a vertical plane that is aligned with the vertical plane occupied by the first post 24 and the second post 44 to allow the rotating arms 56 to rotate in a vertical plane, either in a clockwise or counter-clockwise direction, and to allow each of the rotating arms 56 to move sequentially toward the first post 24. Each of the rotating arms includes an outboard end 58 to which is mounted to any of a multitude of pliable objects for contact with the user's buttocks B, which are positioned between the first post 24 and second post 44 (see FIG. 2). Typical pliable objects that are mountable to each of the outboard ends 58 include flexible flippers 60 (see FIG. 1 and 6), shoes 62 (see FIG. 2 and 5), paddles (not shown), artificial hands (not shown), or other novelty items such as inflated balloons (not shown).

Figure 6:
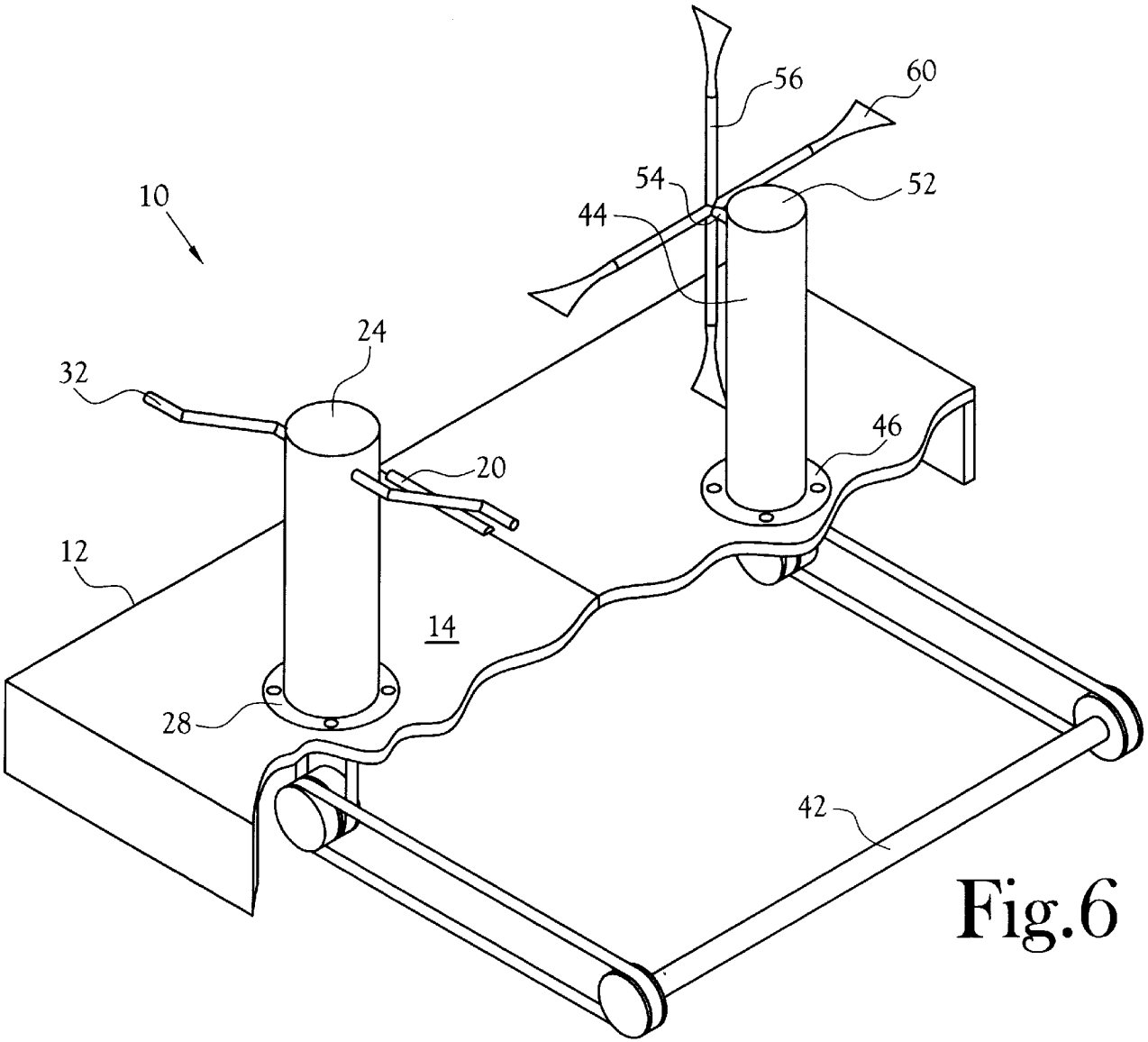
FIG. 6 is a perspective view of an alternative embodiment of the drive means for connecting the crank and the rotating arms of the present invention.
Figure 7:
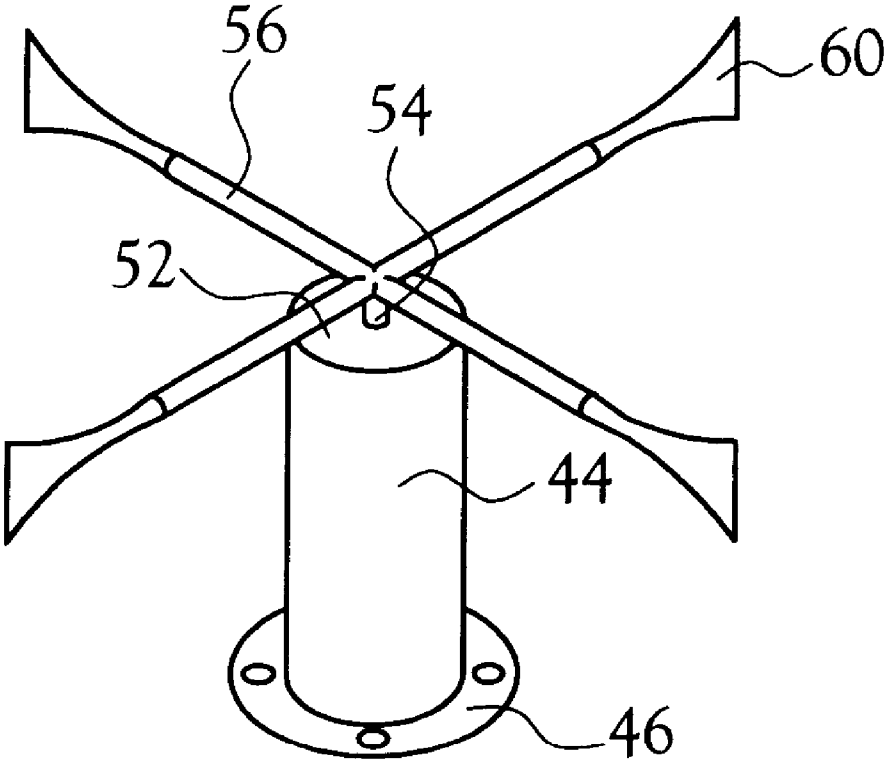
FIG. 7 is a perspective view of an alternative embodiment of the orientation of the plurality of rotating arms of the present invention.

In one embodiment illustrated in FIG. 1 and 6, flexible flippers 60 are mounted on each of the rotating arms 56 to contact the user's buttocks B when the user rotates the hand crank 32. In another embodiment illustrated in FIGS. 2, 4, and 5, flexible shoes 62 are mounted to each outbound end 58 to contact the user's buttocks B when the user rotates the hand crank 32. In an alternate embodiment (not shown), the rotational central axis member 54 is oriented on top of the second post 44 to allow the plurality of rotating arms 56 to rotate in a horizontal plane, either in a clockwise or counter-clockwise direction, so that each of the rotating arms 56 move sequentially toward the first post 24 and strike across the user's buttocks B positioned between the first post 24 and second post 44.

An alternate embodiment includes the platform 12 having an overhead display frame 64 that is connectable to one side of the platform 12, to allow a display sign to be attachable to the display frame 64.

The benefit of the present invention is as an amusement apparatus for entertainment and comic relief whereby the plurality of rotating arms rotate when the user. rotates the hand crank, with the rotational movement transmitted by the drive train to the rotating arms, causing respective outboard ends of each arm of the plurality of rotating arms to strike the user's buttocks B when the user is positioned with his or her buttocks B facing the plurality of rotating arms of the second post.

Figure 8:
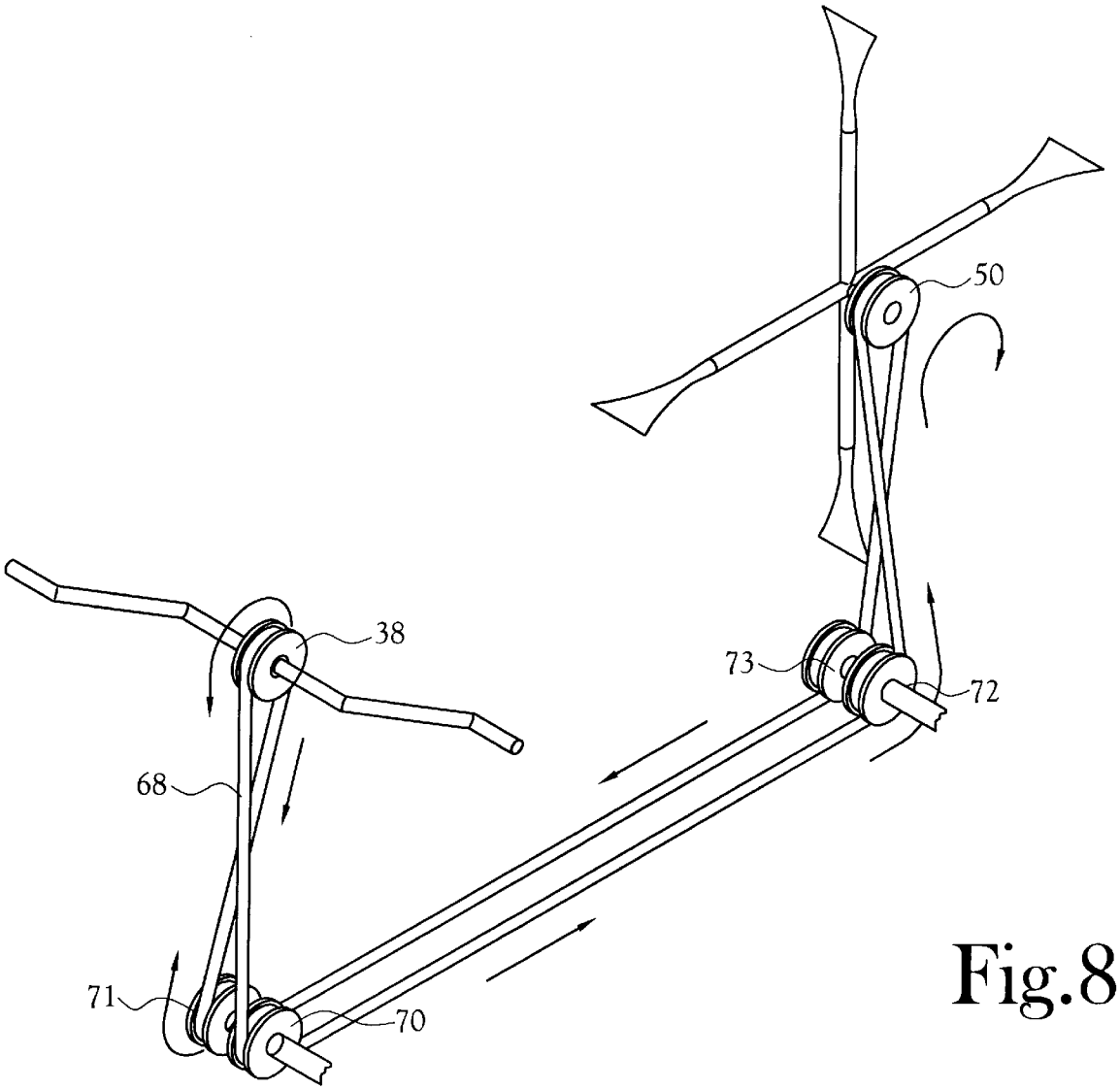
FIG. 8 is a perspective view illustrating an alternative drive train of the present invention.

A number of associated mechanical components known to those skilled in the art are illustrated in FIGS. 1–8 for completeness. A plurality of mechanically connected belts or chains, gears, cams, and/or rotating shafts known to one skilled in the art are alternatively utilized with the buttocks B paddling apparatus. An alternate embodiment provides a drive train including a continuous belt as illustrated in FIG. 8. The continuous belt 68 encircles first pulley 38 and extends to second pulley 50 along a drive train pathway including a set of third pulleys 70, 71 proximate the first pulley 38, and a set of fourth pulleys 72, 73 proximate the second pulley 50. The belt 68 descends from the first pulley 38, proceeds around an outboard third pulley 70, and extends to an outboard fourth pulley 72. The belt 68 proceeds around fourth pulley 72, extends to and partially encircles second pulley 50, descends along a return pathway around an inboard fourth pulley 73, extends to an inboard third pulley 71, and extends to partially encircle first pulley 38. The continuous belt 68 may be constructed of a high-strength material that withstands wear without significant stretching during operation, such as polyurethane.

One skilled in the art will recognize that a visual display in the form of a LCD display can connect to the drive train and can provide the rotational speed of rotating arms that strike the user's buttocks B, and/or a display of the number of paddles or shoes contacting the user's buttocks B per unit of time. Mechanical components which support the system are illustrated for clarity only, and other embodiments could be utilized without interfering with the objects and advantages of the present invention.

From the foregoing description, advantages will be recognized by those skilled in the art for the amusement apparatus including a user controlled cranking apparatus positioned on a platform with a drive train delivering rotational movement generated by operation of a crank positioned on a first post, to a plurality of rotating arms bearing flexible extensions for self-paddling the user's buttocks B. One advantage of the amusement apparatus is that the rate of cranking, and the rate of self-paddling is directly controlled by the user, with no significant delays in transmission of rotational movement provided by the user, and no significant delays for resetting the apparatus or repositioning, the user. The amusement apparatus is operated by one user for self-kicking the user's buttocks, or an alternative embodiment allows one user to operate the crank while a second person positions himself to receive a paddling of his buttocks B for entertainment of observers. The amusement apparatus is configured into at least two subunits connected by hinges for ease of assembly and disassembly. An alternate embodiment provides more than two subunits for variable sizing of the platform to fit the space allowed for the apparatus at local fairs, parades, circuses, or other gatherings of persons.

While a preferred embodiment is shown and described, it will be understood that it is not intended to limit the disclosure, but rather it is intended to cover all modifications and alternate methods falling within the spirit and the scope of the invention as defined in the appended claims. One skilled in the art will recognize variations and associated alternative embodiments. The foregoing description should not be limited to the description of the embodiment of the invention contained herein.

Having thus described the aforementioned invention, I claim:

1. An amusement apparatus operated and controlled by a user, comprising:

a platform having a first end and a second end;

first post and second posts detachably mounted on said platform, said first post positioned toward said first end and said second post positioned toward said second end of said platform at a distance from said first post sufficient to permit the user to locate therebetween, facing said first post;

said first post having a crank positioned at a height thereon which requires the user to bend forward toward said first post while grasping said crank with both hands, to prominently present his buttocks toward said second post;

said second post including a top end having a plurality of rotating arms detachably mounted thereon, said plurality of rotating arms having a central axis positioned at a height generally level with the user's buttocks;

an outboard end on each of said plurality of rotating arms; and a drive train operatively interconnecting between said crank and said central axis of said plurality of rotating arms;

whereby as the user bends forward while grasping said crank, the user bends at his waist to predominantly present his buttocks toward said outboard end on each of said plurality of rotating arms, and the user operates said crank to engage said drive train and to rotate said plurality of rotating arms, causing each respective outboard end on each of said plurality of rotating arms to sequentially strike the user's buttocks.

2. The amusement apparatus of claim 1, wherein each outboard end of each rotating arm includes a pliable paddle mountable thereon.

3. The amusement apparatus of claim 1, wherein each outboard end of each rotating arm includes a flexible shoe mountable thereon.

4. The amusement apparatus of claim 1, wherein said drive train comprises:

first pulley means secured to and rotatable by said crank;

second pulley means secured to said plurality of rotating arms;

shaft means extending between said first and second posts and having first and second ends which are disposed proximate said first and second posts, respective;

third pulley means secured to said first end of said shaft;

fourth pulley means secured to said second end of said shaft;

first flexible continuous loop means entrained about said first and third pulleys for simultaneous rotation of said third pulley, said fourth pulley and said shaft upon rotation of said crank and said first pulley connected thereto; and second flexible continuous loop means entrained about said second and fourth pulleys for rotating said plurality of rotating arms about said central axis upon rotation of said shaft;

whereby the rate of rotation of said plurality of rotating arms is a function of the rate of rotation of said crank to provide user control over both the rate of rotation of said plurality of rotating arms, hence the frequency and degree of force imparted to the user's buttocks upon impact of each of said plurality of rotating arms with the user's buttocks.

5. The amusement apparatus of claim 4, wherein said platform includes:

a central mid-section separating said first and second ends of said platform, said mid-section including first and second opposite side edges, and first and second hinges mounted on respective ones of said first and second side edges of said mid-section and spanning the width dimension of said central mid-section, and hingedly connecting said first and second ends of said platform to respective ones of said first and second ends of said platform;

whereby said first and second ends may be folded back upon said mid-section when said central shaft and said first and second posts are demounted from said platform.

6. The amusement apparatus of claim 1, wherein said drive train comprises:

first pulley means secured to and rotatably by said crank;

second pulley means secured to said plurality of rotating arms;

third pulley means secured proximate said first pulley, said third pulley means including a pair of third pulleys aligned side-by-side, said pair of third pulleys having an outboard third pulley and an inboard third pulley;

fourth pulley means secured proximate said second pulley, said fourth pulley means including a pair of fourth pulleys aligned side-by-side, said pair of fourth pulleys having an outboard fourth pulley and an inboard fourth pulley; and a flexible continuous loop means entrained respectively about said first pulley, said outboard third pulley, said outboard fourth pulley, said second pulley, said inboard fourth pulley, said inboard third pulley, and said first pulley for simultaneous rotation of each pulley upon rotation of said crank and said plurality of rotating arms;

whereby the rate of rotation of said plurality of rotating arms is a function of the rate of rotation of said crank to provide user control over both the rate of rotation of said plurality of rotating arms, hence the frequency and degree of force imparted to the user's buttocks upon impact of each of said plurality of rotating arms with the user's buttocks.

7. An amusement apparatus operated and controlled by a user, comprising:

a platform having a first end and a second end;

first and second upstanding posts detachable mounted on said platform, said first post positioned toward said first end and said second post positioned toward said second end of said platform at a distance from said first post sufficient to permit the user to locate therebetween, on said platform and facing said first post;

a crank rotatably mounted on said first post, said crank positioned at a height above said platform which requires the user to bend forward at the waist and toward said first post to grasp said crank with both hands, thereby prominently presenting the user's buttocks toward said second post;

a plurality of rotating arms rotatably mounted on said second post, said plurality of rotating arms having a central axis positioned at a height generally level with the user's buttocks, said plurality of rotating arms disposed within a vertical plane that is substantially parallel with a vertical plane occupied by said first post;

an outboard end on each of said plurality of rotating arms; and a drive train operatively interconnecting between said crank and said central axis of said plurality of rotating arms;

whereby as the user grips said crank, the user bends forward at the waist to predominantly present the user's buttocks toward said outboard end on each of said plurality of rotating arms, and the rotation said crank by the user activates said drive train to rotate said plurality of rotating arms, causing each respective outboard end on each of said plurality of rotating arms to sequentially strike the user's buttocks, the frequency and force of impact of said outboard ends of said plurality of arms being a function of the rate of rotation of said crank.

8. The amusement apparatus of claim 7, wherein each outboard end of each rotating arm includes a pliable paddle mountable connectable thereon.

9. The amusement apparatus of claim 7, wherein each outboard end of each rotating arm includes a flexible shoe mountable thereon.

10. The amusement apparatus of claim 7, wherein said drive train comprises:

first pulley means secured to and rotatable by said crank;

second pulley means secured to said plurality of rotating arms;

shaft means extending between said first and second posts and having first and second ends which are disposed proximate said first and second posts, respective;

third pulley means secured to said first end of said shaft;

fourth pulley means secured to said second end of said shaft;

first flexible continuous loop means entrained about said first and third pulleys for simultaneous rotation of said third pulley, said fourth pulley and said shaft upon rotation of said crank and said first pulley connected thereto; and second flexible continuous loop means entrained about said second and fourth pulleys for rotating said plurality of rotating arms about said central axis upon rotation of said shaft;

whereby the rate of rotation of said plurality of rotating arms is a function of the rate of rotation of said crank to provide user control over both the rate of rotation of said plurality of rotating arms, hence the frequency and degree of force imparted to the user's buttocks upon impact of each of said plurality of rotating arms with the user's buttocks.

11. The amusement apparatus of claim 1, wherein said platform comprises a display sign detachably connected to said platform.

12. An amusement apparatus operated and controlled by a user, comprising:

a platform having a first end and a second end;

first post and second posts detachably mounted on said platform, said first post positioned toward said first end and said second post positioned toward said second end of said platform at a distance from said first post sufficient to permit the user to locate therebetween, facing said first post;

said first post having a crank positioned at a height thereon which requires the user to bend forward toward said first post while grasping said crank with both hands, to prominently present his buttocks toward said second post;

said second post including a top end having a plurality of rotating arms detachably mounted thereon, said plurality of rotating arms having a central axis positioned at a height generally level with the user's buttocks;

an outboard end on each of said plurality of rotating arms, each of said outboard end including a flexible shoe mountable thereon; and a drive train operatively interconnecting between said crank and said central axis of said plurality of rotating arms;

whereby as the user bends forward while grasping said crank, the user bends at his waist to predominantly present his buttocks toward said outboard end on each of said plurality of rotating arms, and the user operates said crank to engage said drive train and to rotate said plurality of rotating arms, causing each respective outboard end on each of said plurality of rotating arms to sequentially strike the user's buttocks, the frequency and force of impact of each respective outboard end of said plurality of arms being a function of the rate of rotation of said crank.

13. The amusement apparatus of claim 12, wherein said drive train comprises:

first pulley secured to and rotatable by said crank;

second pulley secured to said plurality of rotating arms;

shaft extending between said first and second posts and having first and second ends which are disposed proximate said first and second posts, respective;

third pulley secured to said first end of said shaft;

fourth pulley secured to said second end of said shaft;

first flexible continuous loop entrained about said first and third pulleys for simultaneous rotation of said third pulley, said fourth pulley and said shaft upon rotation of said crank and said first pulley connected thereto; and second flexible continuous loop entrained about said second and fourth pulleys for rotating said plurality of rotating arms about said central axis upon rotation of said shaft;

whereby the rate of rotation of said plurality of rotating arms is a function of the rate of rotation of said crank to provide user control over both the rate of rotation of said plurality of rotating arms, hence the frequency and degree of force imparted to the user's buttocks upon impact of each of said plurality of rotating arms with the user's buttocks.

14. The amusement apparatus of claim 13, wherein said platform comprises:

a central mid-section separating said first end and said second end of said platform, said mid-section including first and second opposite side edges; and first and second hinges mounted on respective ones of said first and second side edges of said mid-section and spanning the width dimension of said central mid-section, and hingedly connecting said first end and said second end of said platform to respective ones of said first and second ends of said platform;

whereby said first and second ends may be folded back upon said mid-section when said central shaft and said first and second posts are demounted from said platform.

* * * * *